United States Patent [19]

Yunoki et al.

[11] 4,313,390

[45] Feb. 2, 1982

[54] TANKER CONSTRUCTION

[75] Inventors: Shigeto Yunoki, Tokyo; Masataka Makizono, Sakado, both of Japan

[73] Assignee: Yamashita-Shinnihon Steamship Co., Ltd., Tokyo, Japan

[21] Appl. No.: 124,943

[22] Filed: Feb. 26, 1980

[30] Foreign Application Priority Data

Mar. 14, 1979 [JP] Japan ..... 54-029788

[51] Int. Cl.[3] ..... B63B 39/03

[52] U.S. Cl. ..... 114/74 R; 114/125

[58] Field of Search ..... 114/74 R, 74 A, 125, 114/333

[56] References Cited

U.S. PATENT DOCUMENTS 3,209,715 10/1965 Campbell et al. ..... 114/74 R 4,030,438 6/1977 Telfer ..... 114/74 R

*Primary Examiner*—William A. Cuchlinski, Jr.

*Attorney, Agent, or Firm*—Koda and Androlia

[57] ABSTRACT

A tanker having a bow part, a stern part, and a midship tank part between them with a inner bottom therein. The midship tank part is divided by bulkheads into cargo tanks above the inner bottom, segregated deep ballast tanks at the same level as the cargo tanks, and segregated double bottom ballast tanks under the inner bottom.

2 Claims, 5 Drawing Figures

FIG. 1
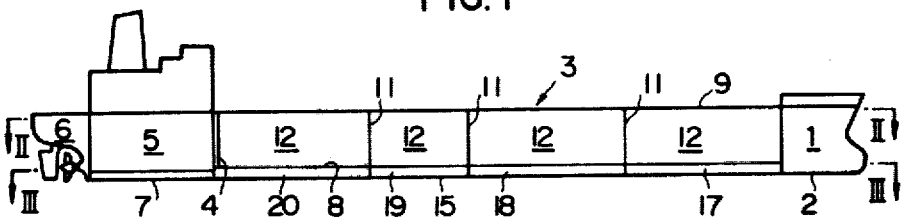
FIG. 2
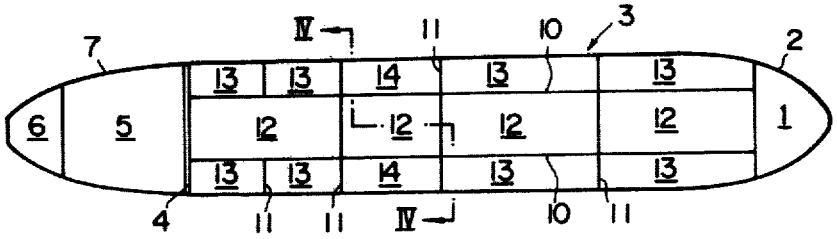
FIG, 3
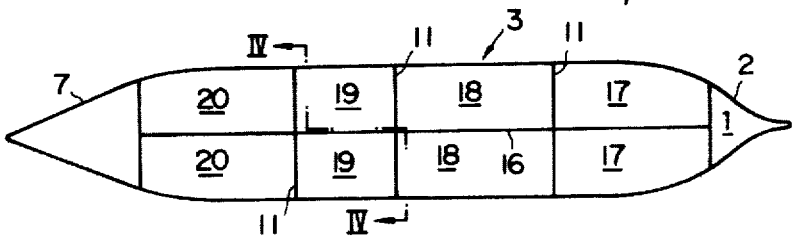

TANKER CONSTRUCTION

BACKGROUND OF THE INVENTION

This invention relates to a tanker having segregated water ballast tanks sufficient for allowing the tanker to operate safely on ballast voyages without recourse to the use of cargo tanks for water ballast. Therefore, oily ballast water will not be discharged from the tanker.

A known tanker of this type has an inner bottom under cargo tanks, and provides segregated ballast tanks between the inner bottom and hull bottom. This tanker tends toward a bottom heavy condition on ballast voyages owing to the lower position of the water ballast, thus providing worse habitability. In addition, this design requires double bottom tanks of excessively high depth, which results in increasing hull weight and higher building cost.

Another known tanker provides segregated ballast tanks at the same level as the cargo tanks, and, of course, has no inner bottom under cargo tanks. On this type of tanker, damage to the bottom in the event of grounding may readily cause leakage of cargo oil. In addition, single bottom tankers require longer pumping time because cargo oil pump location relative to the cargo tank bottom level is higher than that of the double bottom tanker.

SUMMARY OF THE INVENTION

According to this invention there is provided a tanker with an inner bottom spaced from the hull bottom. Longitudinal and transverse bulkheads form segregated deep ballast tanks as well as cargo tanks above the inner bottom, and also form segregated double bottom ballast tanks under the inner bottom. The deep ballast tanks above the inner bottom allows the double bottom ballast tank depth to be reduced to a moderate value, as a result, reduced hull weight and lower building cost will follow. The deep ballast tanks also eliminate the possibility of bottom heavy condition. By selecting the longitudinal location of the deep ballast tanks, suitable trim will be provided on both full-loaded and ballast voyages.

The deep ballast tanks are preferably joined to the double bottom ballast tanks just under them by perforating the inner bottom in part. This arrangement simplifies the ballast piping.

BRIEF DESCRIPTION OF THE DRAWINGS

While the invention is particularly pointed out and distinctly claimed in a concluding portion of the specification a preferred embodiment is set forth in the following detailed description which may be best understood when read in connection with the following drawings, in which:

FIG. 1 is a longitudinal sectional view of a tanker;

FIG. 2 is a sectional view taken on line II—II in FIG. 1;

FIG. 3 is a sectional view taken on line III—III in FIG. 1;

DETAILED DESCRIPTION OF THE INVENTION

Figure 4:
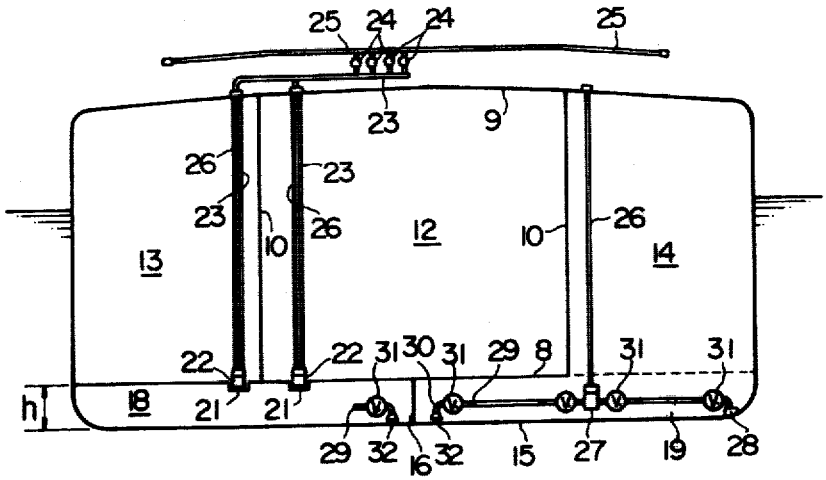
FIG. 4 is a midship sectional view taken on bent line IV—IV in FIGS. 2 and 3.

Refering now to the drawings, there is shown a tanker of 50,000 tons deadweight, which has a bow part 2, a stern part 7, and a midship tank part 3 between them. The bow part 2 includes a forepeak water ballast tank 1, and the stern part 7 also includes a machinery space 5, afterpeak water ballast tank 6, and a cofferdam 4.

An inner bottom 8 with the full breadth of the ship extends over the length of the midship tank part 3 and machinery space 5. Two rows of longitudinal bulkheads 10 also extend over the length of the midship tank part 3. Transverse bulkheads 11 are provided between the side shell plates. The longitudinal and transverse bulkheads 10, 11 divide the space within the midship tank part 3 into center cargo tanks 12, wing cargo tanks 13, and segregated deep ballast tanks 14. Transverse bulkheads 11, together with a center girder 16 extending longitudinally along the keel, divide the double bottom space into segregated ballast tanks 17, 18, 19, 20. The third double bottom tanks 19 are actually joined to the deep ballast tanks 14 by perforating the inner bottom 8 in part as shown in FIG. 4.

The vertical depth h of the double bottom tanks 17, 18, 19, 20 is preferably about one-sixteenth the breadth of ship. This value will normally minimize the hull weight. Longitudinal location of the deep ballast tanks 14 is so determined as to provide suitable trim on full-loaded and ballast voyages.

In the cargo tanks 12, 13 are formed suction wells 21, in which submerged cargo pumps 22 are mounted as shown in FIG. 4. The pump 22 incorporates a hydraulic motor, for which oil is supplied through pipes 26 from a hydraulic oil source (not shown) on the upper deck 9. Cargo oil branch pipes 23 extend from the discharge sides of the cargo oil pumps 22 to cargo oil main pipes 24 which run longitudinally on the upper deck 9. The cargo oil main pipes 24 are joined with shore connections 25 at the midship.

In cargo loading, cargo sent from shore pumps (not shown) flows through the shore connections 25 and cargo oil main and branch pipes 24, 23, past the cargo oil pumps 22, into each of cargo tanks 12, 13. Also in unloading, the cargo pumped from each of the cargo tanks 12, 13 by the cargo pumps 22 flows through cargo branch and main pipe 23, 24, past shore connections 25 to shore tanks (not shown).

In the double bottom ballast tanks 19 are installed submerged ballast pumps 27 incorporating a hydraulic motor, which is supplied with oil through pipes 26 from the hydraulic source.

Figure 5:
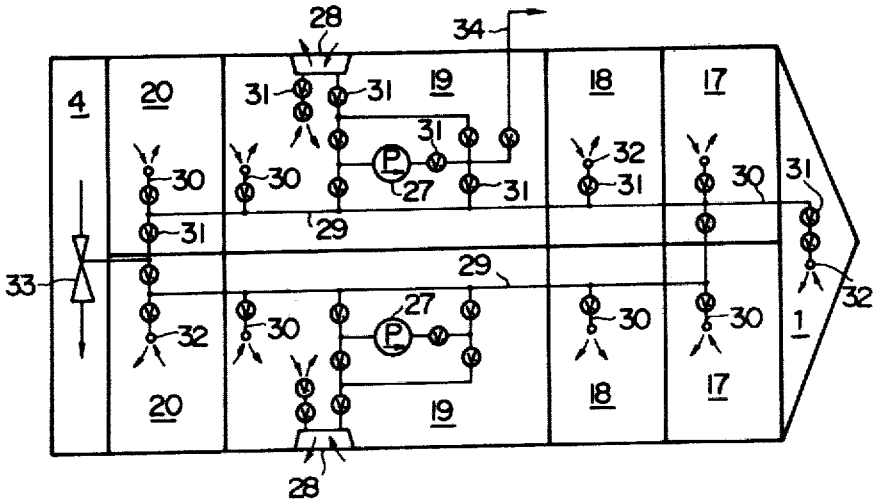
FIG. 5 is a schematic diagram of a ballast pumping system.

A ballast pumping diagram is shown in FIG. 5. Ballast main pipe 29 runs longitudinally within the double bottom space, and branch pipes 30 connecting to the main pipe 29 extend to the bottom of each double bottom ballast tank 17, 18, 19, 20 and the forepeak ballast tank 1. In the tanks 19 are located sea chests 28 the inside of which communicate with the outside of the hull. The ballast pumps are connected between the main pipe 29 and the sea chest 28 so as to ballast and deballast each ballast tank. The numeral 31 indicates a valve, and 32 is a suction bell-mouth.

A pipe 34 branches off from the delivery side of the pump 27 and leads to the second center cargo tank 12. This pipe provides additional water ballast to the cargo tank for the safety of ship in extremely severe weather conditions.

A water-drive ejector 33 for backing up the ballast pumps 27 is provided in the cofferdam 4, the suction of which is connected to the main pipes 29.

The term "segregated ballast tank" is used hereinabove and in the appended claims to describe a tank in which water ballast only is carried and no cargo is loaded.

Although what has been described herein is a preferred embodiment of the invention, it is, of course, to be understood that various modifications and changes may be made therein without departing from the invention. It is, therefore, intended to cover in the following claims all such modifications and changes as may fall within the true spirit and scope of the invention.

We claim:

1. A tanker for carrying a liquid cargo in bulk over the water, comprising:

an outer hull shell defined by a hull bottom, a pair of hull sides and a deck, said hull shell containing a bow part with a forepeak tank, a stern part with a machinery room, and a midship tank part between said bow part and said stern part;

an inner bottom in said midship tank part spaced from said hull bottom and extending horizontally across the full breadth of the tanker;

bulkhead means for dividing the space within said midship tank part to form a plurality of cargo tanks and one or more segregated deep ballast tanks above said inner bottom, and also to form a plurality of segregated double bottom ballast tanks under said inner bottom, said bulkhead means comprising two rows of parallel longitudinal bulkheads extending the full length of said midship tank part from said stern part to said bow part and dividing the region of said midship tank part above said inner bottom into a central tank area flanked by two wing tank areas, a center girder located between said hull bottom and said inner bottom and extending longitudinally from said stern part to said bow part, and a plurality of transverse bulkheads extending transversely across the full breadth of the ship for dividing said center tank area into plurality of central cargo tanks and for dividing each of said wing tank areas into a plurality of wing tanks, at least one of said wing tanks functioning as a wing cargo tank and at least one of said wing tanks between two adjacent ones of said transverse bulkheads functioning as a wing segregated deep ballast tank, said center girder and said plurality of transverse bulkheads dividing the space between said hull bottom and said inner bottom into a plurality of segregated double bottom ballast tanks;

cargo pumping means for loading or unloading said liquid cargo into or from said cargo tanks; and ballast pumping means for ballasting or deballasting said deep ballast tanks and said double bottom ballast tanks.

2. a tanker according to claim 1, wherein each of said wing deep ballast tanks is joined to a respective one of said double bottom ballast tanks just under said each deep ballast tank by partially perforating said inner bottom.

* * * * *